US008820663B2

(12) United States Patent
Vidusek et al.

(10) Patent No.: US 8,820,663 B2
(45) Date of Patent: Sep. 2, 2014

(54) PRESSURIZED AIR ASSISTED SPRAY NOZZLE ASSEMBLY

(75) Inventors: Daniel A. Vidusek, Hampshire, IL (US); Emily Pope, Glen Ellyn, IL (US)

(73) Assignee: Spraying Systems Co., Wheaton, IL (US)

( * ) Notice: Subject to any disclaimer, the term of this patent is extended or adjusted under 35 U.S.C. 154(b) by 208 days.

(21) Appl. No.: 13/559,122

(22) Filed: Jul. 26, 2012

(65) Prior Publication Data

US 2013/0186982 A1 Jul. 25, 2013

Related U.S. Application Data

(60) Provisional application No. 61/514,713, filed on Aug. 3, 2011.

(51) Int. Cl.
*B05B 7/04* (2006.01)
*B05B 1/04* (2006.01)

(52) U.S. Cl.
CPC ..... *B05B 1/04* (2013.01); *B05B 7/0433* (2013.01)
USPC ..... 239/434; 239/429; 239/597

(58) Field of Classification Search
USPC ..... 239/8, 290, 398, 423, 426, 427, 239/429–434, 434.5, 589, 597, 598
See application file for complete search history.

(56) References Cited

U.S. PATENT DOCUMENTS 3,240,254 A * 3/1966 Hughes ..... 122/24
3,899,130 A 8/1975 Bell, Jr.
4,591,099 A 5/1986 Emory et al.
5,176,325 A 1/1993 Vidusek
5,732,885 A * 3/1998 Huffman ..... 239/416.5
6,161,778 A * 12/2000 Haruch ..... 239/290
6,267,301 B1 * 7/2001 Haruch ..... 239/290
6,726,127 B2 * 4/2004 Hofherr et al. ..... 239/432
7,036,753 B2 5/2006 Huffman

OTHER PUBLICATIONS

U.S. Patent & Trademark Office, International Search Report in International Patent Application No. PCT/US2012/049328 (Oct. 8, 2012).

U.S. Patent & Trademark Office, Written Opinion of the International Search Authority in International Patent Application No. PCT/US2012/049328 (Oct. 8, 2012).

* cited by examiner

*Primary Examiner* — Darren W Gorman
(74) *Attorney, Agent, or Firm* — Leydig, Voit & Mayer, Ltd.

(57) ABSTRACT

A pressurized air-assisted liquid spray nozzle assembly having an air direction member that defines a central longitudinal airflow passage having an upstream end for coupling to a pressurized air supply and a plurality of cross-passages for directing a plurality of pressurized air streams radially outwardly, a liquid direction guide disposed in surrounding relation to the air direction member having a plurality of circumferentially spaced liquid passages extending transversely across the cross-passages for intersecting pressurized liquid and air streams and pre-atomizing the liquid, a downstream expansion chamber for receiving pre-atomized liquid, and discharge orifice communicating centrally with the expansion chamber for emitting a predetermined atomized liquid spray pattern.

20 Claims, 3 Drawing Sheets

PRESSURIZED AIR ASSISTED SPRAY NOZZLE ASSEMBLY

CROSS-REFERENCE TO RELATED APPLICATIONS

This patent application claims the benefit of U.S. Provisional Patent Application No. 61/514,713, filed Aug. 3, 2011, which is incorporated by reference.

BACKGROUND OF THE INVENTION

The present invention relates generally to pressurized air assisted liquid spray nozzles, and more particularly, to pressurized air assisted liquid spray nozzles useful in metal cooling, catalytic cracking, gas scrubbing, and other industrial processing.

BACKGROUND OF THE INVENTION

Internal mix pressurized air assisted liquid spray nozzles are useful in generating fine liquid particle spray discharges useful in many industrial applications. For generating a fine liquid particle discharge, such spray nozzles commonly (1) interact pressured air and liquid flow streams within the nozzle, and (2) impinge the liquid or preatomized liquid flow streams on an impingement post or like impingement element disposed within the nozzle assembly. When the liquid stream initially is directly impinged upon an impingement post, such as shown in U.S. Pat. No. 4,591,099, the liquid particles sometimes can agglomerate into larger sizes before final discharge from the spray nozzle. When a preatomized liquid flow stream is impinged upon a downstream impingement post, such as shown in U.S. Pat. No. 7,036,753, the impingement post, which is centrally mounted within the nozzle, precludes the discharge of flat or centrally directed round spray patterns required for many spray applications. Moreover, because of the manner in which the liquid and pressurized air flow streams interact in such nozzles, it sometimes can be difficult to precisely control the spectrum of the fine particle liquid discharge from the nozzle. Also, because large numbers of such pressurized air assisted spray nozzles often are required in industrial spraying systems, relatively large pressurized air requirements are needed, which is costly.

OBJECTS AND SUMMARY OF THE INVENTION

It is an object of the present invention to provide an internal mix pressurized air assisted atomizing nozzle which is adapted for generating and discharging a fine liquid particle spray pattern without the necessity for a downstream impingement post that can interfere with the desired spray discharge.

Another object is to provide a spray nozzle assembly as characterized above which is adapted for more effectively interacting and preatomizing liquid and pressurized air flow streams prior to discharge from the nozzle.

A further object is to provide a spray nozzle assembly of the above kind which is effective for spraying a centrally discharged flat or full cone spray patterns.

Still a further object is to provide a spray nozzle assembly of the foregoing type which is operable for effectively preatomizing the liquid flow stream with more efficient pressurized air utilization.

Another object is to provide such a spray nozzle assembly that is relatively simple in construction and which lends itself to economical manufacture.

Other objects and advantages of the invention will become apparent upon reading the following detailed description and upon reference to the drawings, in which:

Figure 1:
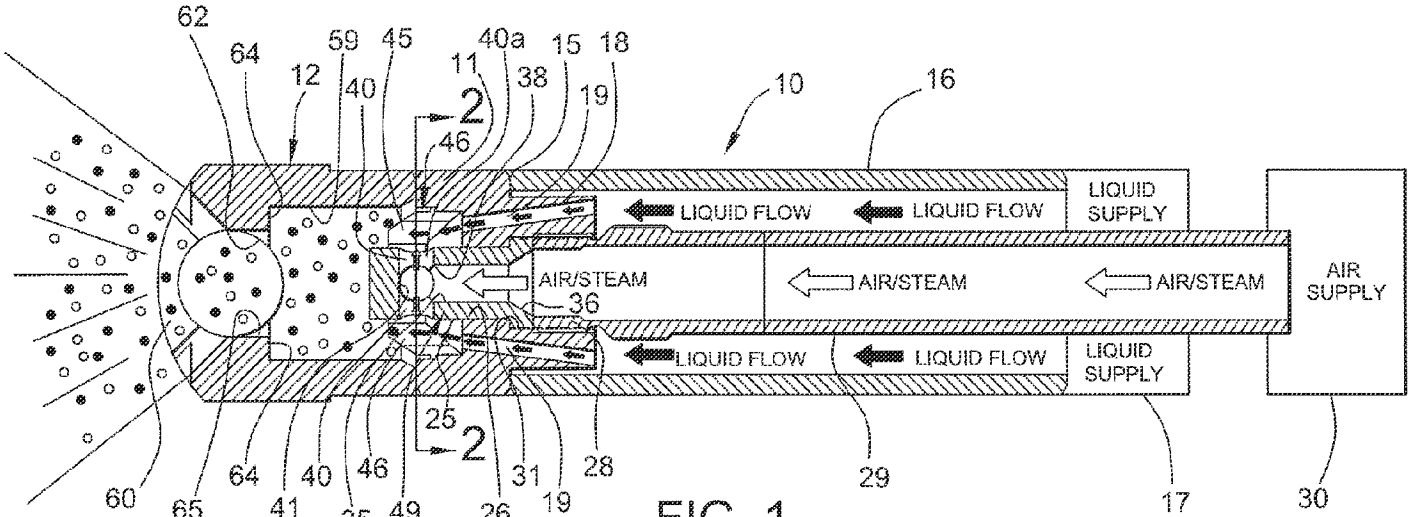
FIG. 1 is a longitudinally section of an illustrative spray nozzle assembly in accordance with the invention.
Figure 2:
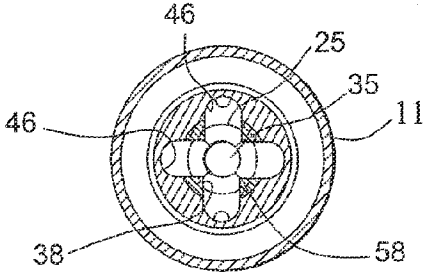
FIG. 2 is a transverse section of the illustrated spray nozzle assembly taken in the plane of line 2-2 in FIG. 1.
Figure 6:
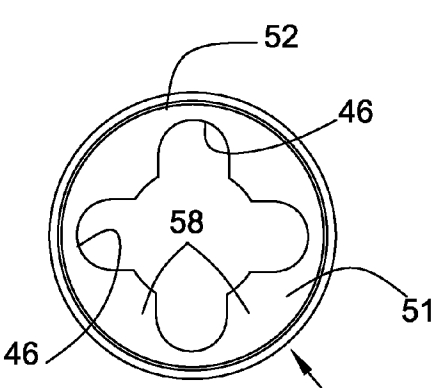
FIG. 6 is an upstream end view of the liquid direction guide shown in FIG. 3.
Figure 5:
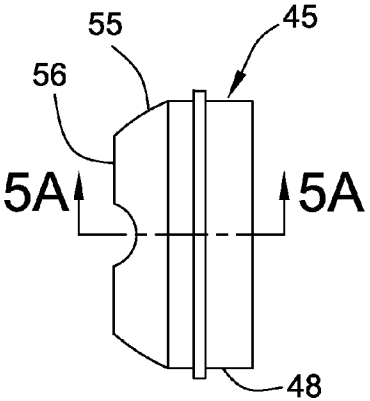
FIG. 5 is a side elevational view of the liquid direction guide shown in FIG. 3.
Figure 5A:
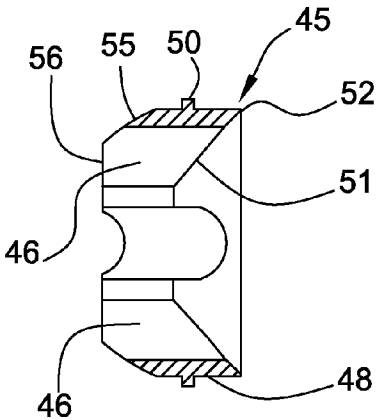
FIG. 5A is a transverse section of the liquid direction guide taken in the plane of line 5A-5A in FIG. 5.
Figure 4:
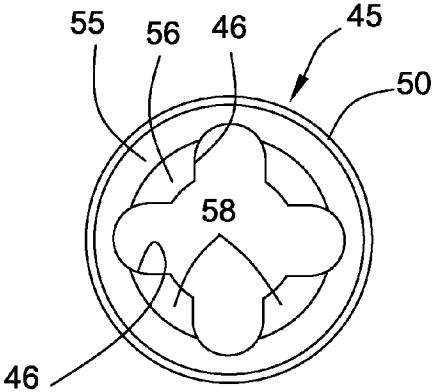
FIG. 4 is a downstream end view of the liquid direction guide shown in FIG. 3.
Figure 3:
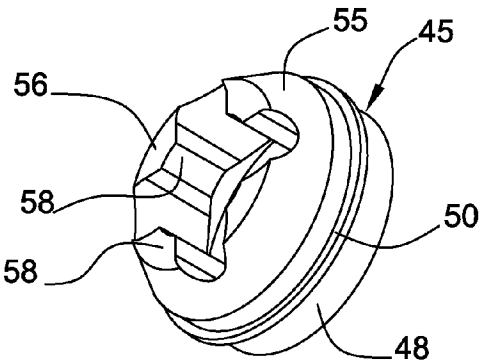
FIG. 3 is a perspective of a liquid direction guide of the illustrated spray nozzle assembly.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative pressurized air assisted liquid spray nozzle assembly 10 in accordance with the invention. The spray nozzle assembly 10 in this case comprises generally cylindrically configured nozzle body 11 having a nozzle tip 12 secured at a downstream end. It will be understood by one skilled in the art that the nozzle tip 12 may be secured in abutting relation to the nozzle body 11 by an appropriate clamp nut or like fastener in a manner known in the art.

The nozzle body 11 in this case is secured, such as by weldments 15, to the downstream end of a liquid supply tube or conduit 16 that is connected to a pressurized liquid supply 17. The illustrated nozzle body 11 has a reduced diameter annular upstream end portion 18 extending into the liquid supply tube 16 formed with a plurality of circumferentially-spaced inlet passages 19 for receiving liquid from the supply tube 16. The inlet passages 19 in this case each extend in slight inwardly converging relation in a downstream direction.

In accordance with the invention, the spray nozzle assembly is operable for more directly and effectively interacting pressurized air and liquid flow streams such that preatomized liquid may be discharged from the nozzle tip without the need for a downstream impingement pin or like impingement element. To this end, in the illustrated embodiment, the spray nozzle assembly 10 has a central air direction tube 25 disposed within a central cylindrical through bore 26 of the nozzle body 11. The air direction tube 25 has an enlarged externally threaded upstream end 28 secured to and communicating with an air supply tube 29 that extends concentrically within the liquid supply tube 16 and which is coupled to a pressurized air supply 30. The enlarged diameter upstream end 28 defines a shoulder that is fixedly located and retained within a counter bore 31 in the central through bore 26 of the nozzle body 11.

The air direction tube 25 in this case has a central longitudinally extending air passage 35 having an inwardly converging conical entry section 36 communicating with the air supply tube 29 through which pressurized air is directed into the nozzle body 11. The longitudinal passage 35 communicates via a downstream air orifice 38 with a plurality cross holes 40, in this case four in number, extending perpendicular to and in intersecting relation with a center axis of the longitudinal air passage 35. Alternatively, to provide maximum flow passage, the air direction tube 25 may be formed with only two relatively larger diameter cross holes 40.

Pressurized air accelerated through the longitudinal air passage 35 of the air direction tube 25 strikes an end wall 41 of a chamber formed by the intersecting cross holes 40. As pressurized an air stream impinges the end wall 41 it is directed radially outwardly through the cross holes 40 exiting 90° circumferentially spaced discharge orifices 40*a* of the cross holes 40.

In carrying out one embodiment, the spray nozzle assembly is effective for directing a plurality of individual pressurized liquid flow streams, corresponding in number to the radially directed pressurized air flow streams, for directly interacting the individual flow streams for enhanced liquid particle breakdown. To this end, the spray nozzle assembly 10 includes an annular liquid direction guide 45 formed with a plurality of circumferentially offset axial passages 46 each communicating between a respective inlet passage 19 of the nozzle body 11 and transversely across a respective radial discharge orifice 40*a* of the air flow direction tube 25. The annular liquid direction guide 45 in this case has an upstream cylindrical portion 48 disposed within a counter bore 49 of the nozzle body 11 with an outer annular flange 50 intermediate its ends press fit into engagement with a locating ledge defined by the counter bore 49. The liquid direction guide 45 is formed with a conical entry section 51 which defines a sharp upstream ledge 52 that is engageable with the end of the nozzle body counter bore 49. The liquid direction guide has a downstream inwardly directed conical section 55 with a radial end face 56.

The axial liquid passages 46 of the illustrated liquid direction guide 45 each have an outwardly radially extending U-shaped configuration which define a plurality of generally triangular configured mounting lugs 58 therebetween that are supported on the downstream end of the air direction tube 25. The axial liquid passages 46 in this case communicate from the upstream conical section 51 of the liquid direction guide 45 through both the downstream conical and end faces 55,56. The downstream end of the liquid direction guide 45 extends to a point adjacent the end of the air direction tube 25 such that the axial longitudinal passages 46 extend completely across the respective radial discharge orifices 50*a* of the air direction tube 25 for ensuring complete interaction of the individual pressurized liquid and air flow streams for effective interaction and preatomization of the liquid.

In carrying out the illustrated embodiment, the preatomized liquid particles are directed at high velocity into an expansion chamber 59 of the nozzle tip 12 downstream of the air direction tube 25 for further breakdown and atomization as an incident to discharge through a downstream axial discharge orifice 60. The expansion chamber 59 in this instance is slightly larger in diameter than the outer diameter of the liquid direction guide 45 and has a relatively short axial length less than its diameter.

The liquid discharge orifice 60 in this case is adapted for directing a generally fan-shaped spray pattern with fine droplets uniformly distributed throughout the spray pattern. The illustrated discharge orifice 60, which may be similar to that disclosed in U.S. Pat. No. 4,591,099 assigned to the same assignee as the present application, the disclosure of which is incorporated hereby reference, is defined in part by a cylindrical mixing chamber 62 adjacent the downstream end of the nozzle tip 12 which extends diametrically across the nozzle tip 12 in perpendicular relation to the longitudinal flow axis of the spray nozzle assembly. The mixing chamber 62 communicates with the discharge orifice 60 which is disposed in transversely across the mixing chamber 62.

Figure 7:
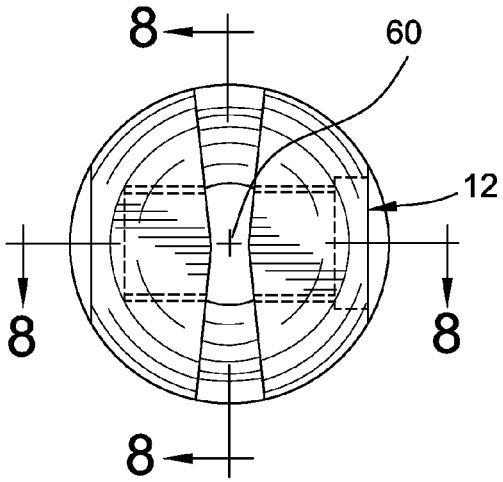
FIG. 7 is a downstream end view of the illustrated spray nozzle assembly.
Figure 8:
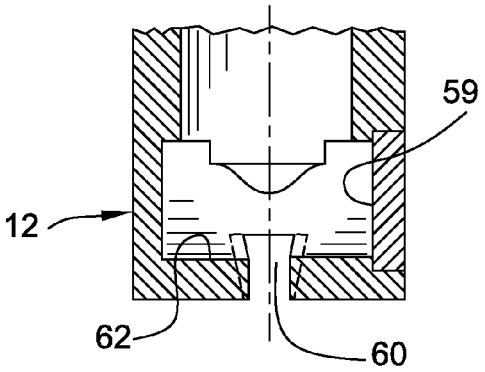
FIG. 8 is a fragmentary section of the nozzle tip of the illustrated spray nozzle assembly taken in the line of 8-8 in FIG. 7.

For enhancing further liquid particle breakdown and mixing of the high velocity preatomized liquid directed into the expansion chamber 59, the expansion chamber 59 of the nozzle tip 12 intersects the mixing chamber 62 well above the center of the mixing chamber 62 so as to define a pair of diametrically opposed segmental shoulders or abutments 64 in a plane perpendicular to the longitudinal axis of the expansion chamber 59. The passage between the shoulders or abutments 64 in this case is defined by an axial bore 65 having substantially the same diameter as the transverse mixing chamber 62. The discharge orifice may be configured for the desired spray pattern, such as by means of a cross slot with outwardly flared opposite ends, as depicted in FIG. 7.

In operation, it can be seen that pressurized air introduced centrally into the spray nozzle assembly is directed into a plurality of high pressure radial flow streams for direct interaction with respective pressurized liquid flow streams for effective and efficient preatomization of the liquid. The preatomized liquid particles are then forcefully directed at high velocity into the expansion chamber for further breakdown and ultimate discharge in the predetermined spray pattern from the centrally disposed discharge orifice of the spray nozzle assembly.

From the foregoing, it can be seen that the spray nozzle assembly of the present invention is effective for generating and discharging fine liquid spray particles without the necessity for a downstream impingement post that can interfere with the desired spray discharge. The spray nozzle assembly, by virtue of the direct interaction of individual liquid and pressurized air flow streams, effectively preatomizes and directs the fine liquid particles with efficient pressurized air utilization.

The invention claimed is:

1. A pressurized air-assisted liquid spray nozzle comprising:

a nozzle body having a liquid spray discharge orifice at a downstream end;

said nozzle body having an upstream end for coupling to a liquid supply;

an air direction member disposed within said nozzle body having a longitudinal airflow passage having an upstream end for coupling to a pressurized air supply;

said air direction member having a plurality of cross-passages extending in transverse intersecting relation to the longitudinal airflow passage for directing a plurality of pressurized air streams radially outwardly through circumferentially spaced air discharge orifices of the cross-passages;

a liquid direction guide within said nozzle body defining a plurality of circumferentially spaced liquid passages corresponding in number to said cross-passages each extending transversely across an air discharge orifice of a respective one of said cross-passages for intersecting pressurized liquid and air streams and pre-atomizing the liquid;

said nozzle body having an expansion chamber for receiving said pre-atomized liquid; and said liquid spray discharge orifice communicating centrally with said expansion chamber for emitting a predetermined atomized liquid spray pattern from the spray nozzle.

2. The pressurized air-assisted liquid spray nozzle of claim 1 in which said nozzle body has a spray tip at said downstream end that defines said liquid spray discharge orifice.

3. The pressurized air-assisted liquid spray nozzle of claim 1 including a liquid supply tube coupled to said upstream end of said nozzle body;

an air supply tube disposed within said liquid supply tube coupled to said upstream end of said air direction member for supplying pressurized air to the longitudinal airflow passage of said air direction member; and said air supply tube being disposed centrally within said liquid supply tube for defining an annular liquid flow passage about said air supply tube for communicating liquid to said liquid direction guide.

4. The pressurized air-assisted liquid spray nozzle of claim 1 in which said air direction member cross-passages extend outwardly perpendicularly in relation to said longitudinal airflow passage; and said liquid direction guide circumferentially spaced liquid passages extend in parallel relation to the air direction member longitudinal airflow passage and in perpendicular relation to said cross-passages.

5. The pressurized air-assisted liquid spray nozzle of claim 1 in which said nozzle body includes a plurality of liquid passageways each communicating with said circumferentially spaced liquid passages of the liquid direction guide.

6. The pressurized air-assisted liquid spray nozzle of claim 1 in which said liquid spray discharge orifice is defined at least by a cross slot extending transversely to an axis of said longitudinal airflow passage for discharging a flat fan spray discharge.

7. The pressurized air-assisted liquid spray nozzle of claim 1 in which said air direction member is formed with a reduced diameter passage section for accelerating air through the air direction member prior to direction through the cross passages.

8. The pressurized air-assisted liquid spray nozzle of claim 1 in which said cross passages define an end wall against which pressurized air directed through said air direction member impinges prior to passage through said cross passages.

9. The pressurized air-assisted liquid spray nozzle of claim 1 in which said circumferentially spaced liquid passages each have a u-shaped configuration which defines a plurality of circumferentially spaced mounting lugs that support the liquid direction guide on the air direction member.

10. The pressurized air-assisted liquid spray nozzle of claim 1 in which said plurality of circumferentially spaced liquid passages extend completely across the air discharge orifices of the cross passages.

11. The pressurized air-assisted liquid spray nozzle of claim 1 in which said liquid direction guide has an inwardly tapered downstream conical end section with a radial end face, and said circumferentially spaced liquid passages communicate through both said downstream conical end section and the radial end face.

12. The pressurized air-assisted liquid spray nozzle of claim 10 in which said liquid direction guide is disposed in surrounding relation to said air direction member with a downstream end of the liquid direction guide being adjacent a downstream end of the air direction member.

13. The pressurized air-assisted liquid spray nozzle of claim 1 in which said expansion chamber has a diameter greater than an outer diameter of the liquid direction guide and an axial length less than the diameter of the expansion chamber.

14. A pressurized air-assisted liquid spray system comprising:

a pressurized liquid supply;

a pressurized air supply;

a spray nozzle having a liquid spray discharge orifice at a downstream end;

said spray nozzle having an upstream end for coupling to said liquid supply;

an air direction member disposed within said spray nozzle having a longitudinal airflow passage having an upstream end for coupling to said pressurized air supply;

said air direction member having a plurality of cross-passages extending in transverse intersecting relation to the longitudinal airflow passage for directing a plurality of pressurized air streams radially outwardly through circumferentially spaced air discharge orifices of the cross-passages;

a liquid direction guide disposed in surrounding relation to the air direction member and defining a plurality of circumferentially spaced liquid passages corresponding in number to said cross-passages each extending transversely across an air discharge orifice of a respective one of said cross-passages for intersecting pressurized liquid and air streams and pre-atomizing the liquid;

said spray nozzle having an expansion chamber for receiving said pre-atomized liquid; and said liquid spray discharge orifice communicating centrally with said expansion chamber for emitting a predetermined atomized liquid spray pattern from the spray nozzle.

15. The pressurized air-assisted liquid spray system of claim 14 in which said spray nozzle has a spray tip at said downstream end that defines said liquid spray discharge orifice as a flat spray discharge orifice.

16. The pressurized air-assisted liquid spray system of claim 14 in which said air direction member cross-passages extend outwardly perpendicularly in relation to said longitudinal airflow passage; and said liquid direction guide circumferentially spaced liquid passages extend in parallel relation to the air direction member longitudinal airflow passage and in perpendicular relation to said cross-passages.

17. The pressurized air-assisted liquid spray system of claim 14 in which said liquid spray discharge orifice is defined by at least one cross slot extending transversely to an axis of said longitudinal airflow passage.

18. The pressurized air-assisted liquid spray system of claim 14 in which said cross passages define an end wall against which pressurized air directed through said air direction member impinges prior to passage through said cross passages.

19. The pressurized air-assisted liquid spray system of claim 14 in which said circumferentially spaced liquid passages each have a u-shaped configuration which defines a plurality of circumferentially spaced mounting lugs that support the liquid direction guide on the air direction member.

20. The pressurized air-assisted liquid spray system of claim 14 in which said liquid direction guide is disposed in surrounding relation to said air direction member with a downstream end of the liquid direction guide being adjacent a downstream end of the air direction member.

* * * * *